US012736231B2

(12) United States Patent
Zhao

(10) Patent No.: US 12,736,231 B2
(45) Date of Patent: Sep. 15, 2026

(54) AIR CONDITIONER INDOOR UNIT AND AIR CONDITIONER

(71) Applicants: MIDEA GROUP WUHAN HEATING & VENTILATING EQUIPMENT CO., LTD., Wuhan (CN); GD MIDEA AIR-CONDITIONING EQUIPMENT CO., LTD., Foshan (CN)

(72) Inventor: Ting Zhao, Wuhan (CN)

(73) Assignees: MIDEA GROUP WUHAN HEATING & VENTILATING EQUIPMENT CO., LTD., Wuhan (CN); GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 86 days.

(21) Appl. No.: 18/723,777

(22) PCT Filed: Aug. 30, 2022

(86) PCT No.: PCT/CN2022/115820
§ 371 (c)(1),
(2) Date: Jun. 24, 2024

(87) PCT Pub. No.: WO2023/124168
PCT Pub. Date: Jul. 6, 2023

(65) Prior Publication Data

US 2025/0067446 A1 Feb. 27, 2025

(30) Foreign Application Priority Data

Dec. 31, 2021 (CN) ..... 202111665908.0

(51) Int. Cl.
*F24F 1/0059* (2019.01)
*F24F 11/89* (2018.01)
*F24F 13/20* (2006.01)

(52) U.S. Cl.
CPC ..... *F24F 1/0059* (2013.01); *F24F 11/89* (2018.01); *F24F 13/20* (2013.01); *F24F 2013/207* (2013.01)

(58) Field of Classification Search
CPC ..... F24F 1/0007; F24F 1/0025; F24F 1/0057; F24F 1/0059; F24F 11/89; F24F 13/20; F24F 2013/207
See application file for complete search history.

(56) References Cited

U.S. PATENT DOCUMENTS 10,663,180 B2 * 5/2020 Sato ..... F24F 1/0025
10,739,034 B2 * 8/2020 Liu ..... F24F 1/0063
(Continued)

FOREIGN PATENT DOCUMENTS

CN 203231414 U 10/2013
CN 204176767 U 2/2015
(Continued)

OTHER PUBLICATIONS

The World Intellectual Property Organization (WIPO) International Search Report and Written Opinion for PCT/CN2022/115820 Nov. 9, 2022 16 Pages (including translation).
(Continued)

*Primary Examiner* — Christopher R Zerphey
(74) *Attorney, Agent, or Firm* — Anova Law Group, PLLC

(57) ABSTRACT

An air-conditioning indoor unit includes a housing with an air duct formed therein, an evaporator arranged in the air duct, and an electric control box arranged at a side of the evaporator. At least a part of the electric control box is located in the air duct.

13 Claims, 7 Drawing Sheets

(56) References Cited

U.S. PATENT DOCUMENTS

| | | | | |
|---|---|---|---|---|
| 10,816,226 | B2 * | 10/2020 | Tomomura | F24F 1/0047 |
| 11,353,224 | B2 * | 6/2022 | Hess | F24F 11/89 |
| 2019/0154277 | A1 | 5/2019 | Jewell et al. | |

FOREIGN PATENT DOCUMENTS

| | | | |
|---|---|---|---|
| CN | 205065925 | U | 3/2016 |
| CN | 106766035 | A | 5/2017 |
| CN | 107300220 | A | 10/2017 |
| CN | 108443972 | A | 8/2018 |
| CN | 208296073 | U | 12/2018 |
| CN | 208779555 | U | 4/2019 |
| CN | 209541015 | U | 10/2019 |
| CN | 209857330 | U | 12/2019 |
| CN | 210463273 | U | 5/2020 |
| CN | 212851508 | U | 3/2021 |
| CN | 214406245 | U | 10/2021 |
| CN | 214501488 | U | 10/2021 |
| CN | 215260065 | U | 12/2021 |
| CN | 215336965 | U | 12/2021 |
| CN | 114251723 | A | 3/2022 |
| CN | 216644353 | U | 5/2022 |
| EP | 2270401 | A1 | 1/2011 |

OTHER PUBLICATIONS

China National Intellectual Property Administration (CNIPA) Office Action 1 for Application No. 202111665908.0 Dec. 19, 2022 19 Pages (including translation).

China National Intellectual Property Administration (CNIPA) Office Action 2 for Application No. 202111665908.0 Apr. 6, 2023 12 Pages (including translation).

State Intellectual Property Office of China Notice of Grant of Invention Patent Right for Application No. 202111665908.0 Jul. 1, 2023 6 pages (including translation).

* cited by examiner

AIR CONDITIONER INDOOR UNIT AND AIR CONDITIONER

CROSS-REFERENCE TO RELATED APPLICATIONS

This application is a National Stage Entry under 35 U.S.C. § 371 of International Application No. PCT/CN2022/115820, filed on Aug. 30, 2022, which is filed based on and claims priority to Chinese Patent application No. 202111665908.0 filed on Dec. 31, 2021, the contents of both of which are hereby incorporated by reference in their entirety.

TECHNICAL FIELD

The disclosure relates to the technical field of air conditioners, and in particular to an air-conditioning indoor unit and an air conditioner.

BACKGROUND

In the related art, in which an electric control box of an air-conditioning indoor unit is arranged out of a housing of the air-conditioning indoor unit, and heat dissipation effect of the electric control box is poor.

SUMMARY

In view of this, it is desired for embodiments of the disclosure to provide an air-conditioning indoor unit, and an air conditioner, which may improve the heat dissipation effect of the electric control box.

In order to achieve the above purpose, an embodiment of the disclosure provides an air-conditioning indoor unit, the air-conditioning indoor unit includes a housing, an evaporator, and an electric control box.

An air duct is defined in the housing.

The evaporator is arranged in the air duct.

The electric control box is arranged at a side of the evaporator, and at least a part of area of the electric control box is located in the air duct.

In an implementation, the electric control box may be located at a side of the evaporator in a lateral direction.

In an implementation, a part of area of the housing may be recessed toward an inner side of the housing to form an installation space communicated with the air duct, and at least the part of area of the electric control box is arranged in the installation space.

In an implementation, an opening communicated with the air duct may be provided at a side of the housing, and a part of sidewall of the housing located at the opening side is recessed to form the installation space.

In an implementation, the air-conditioning indoor unit may include an air outlet frame, a fan and a water collection tray, and the air outlet frame is provided with an air outlet.

The air outlet frame and the fan are arranged in the air duct, the air outlet is communicated with the air duct and faces toward the opening, the fan and the evaporator are arranged at a same side of the air outlet frame, and the fan is located at a side of the evaporator away from the opening.

The water collection tray is arranged at the opening and faces toward the evaporator, and the water collection tray avoids a part of area of the opening, so that the area of the opening avoided by the water collection tray forms an air return port.

In an implementation, the air duct may be provided with a communication port communicated with outside, and the electric control box is arranged on an outer surface of the housing.

A sidewall at a side of the electric control box closes the communication port; or, the part of area of the electric control box extends into the air duct from the communication port.

In an implementation, the electric control box may include a box body and a box cover openably and closably covered on the box body, the box body is connected to the housing, and the box cover is located out of the housing.

In an implementation, the electric control box may further include an air switch arranged in the box body, and the air switch is configured to control on or off of a power supply of the air-conditioning indoor unit.

In an implementation, the box body may include a main box and a secondary box connected to the main box, the box cover includes a main box cover, and the electric control box includes an electric control board.

A side of the main box and a side of the secondary box are opened, the electric control board is arranged in the main box, the main box cover is openably and closably covered at the opened portion of the main box, and the air switch is arranged in the secondary box.

In an implementation, the box cover may further include a secondary box cover provided with an avoidance port, the secondary box cover is openably and closably covered at the opened portion of the secondary box, and a control handle of the air switch extends out of the secondary box cover from the avoidance port.

In an implementation, the secondary box may be arranged at a side of the main box away from the evaporator.

In an implementation, the secondary box may be provided with two second wire passage ports, one of the two second wire passage ports is arranged on a sidewall of the secondary box, and another one of the two second wire passage ports is arranged on a bottom wall of the secondary box.

In an implementation, a part of area of the housing may be recessed toward an inner side of the housing to form an installation space communicated with the air duct, the main box is arranged in the installation space, and the secondary box is arranged out of the installation space and located at a side of the main box away from the evaporator.

An embodiment of the disclosure further provides an air conditioner, the air conditioner includes the above air-conditioning indoor unit.

The embodiments of the disclosure provides an air-conditioning indoor unit and an air conditioner, the electric control box of the air-conditioning indoor unit is arranged at a side of the evaporator, and at least a part of area of the electric control box is located in the air duct. When the air-conditioning indoor unit is in an operation state, airflow flowing through the evaporator may take away heat generated by the electric control box, so that a good heat dissipation function on the electric control box may be achieved, and thus the heat dissipation effect of the electric control box may be improved.

DETAILED DESCRIPTION

It should be noted that the embodiments of the disclosure and technical features in the embodiments may be combined with each other, without conflict; and detailed descriptions in specific implementations should be understood as explanation of the purpose of the disclosure, and should not be considered as undue limitation to the disclosure.

Figure 8:
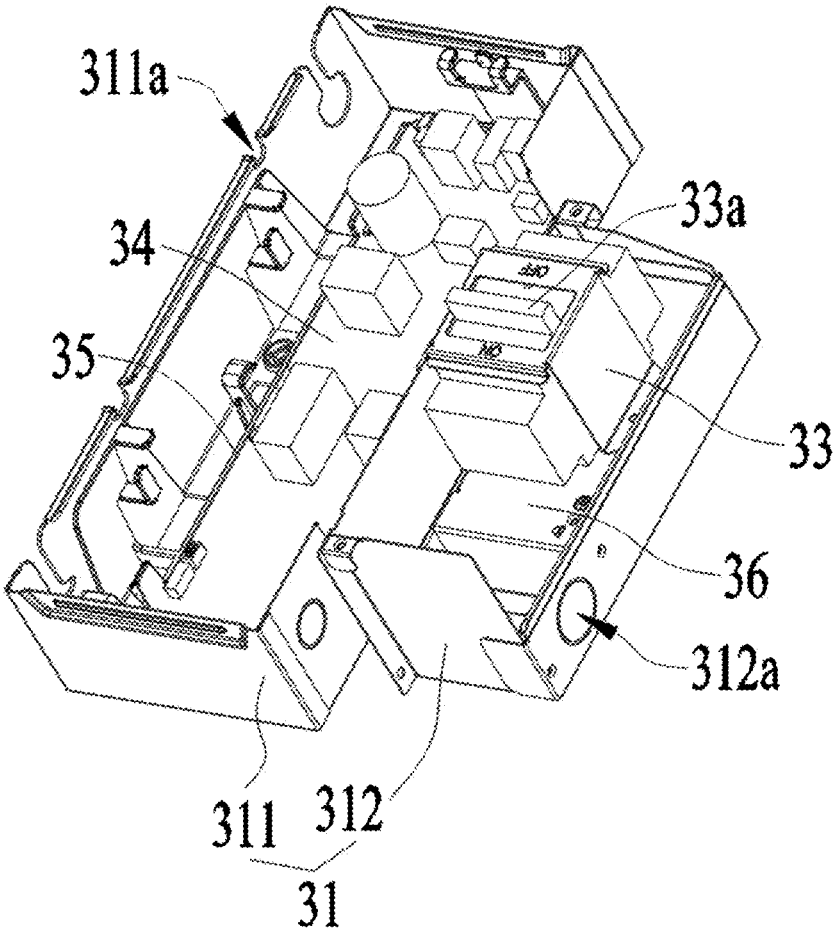
FIG. 8 is a schematic view of an internal structure of the electric control box shown in FIG. 7 from a view angle.

In descriptions of the disclosure, orientation or position relationships of "top," "bottom" and "extension direction" are based on the orientation or position relationship shown in FIG. 8, here "up" is a "top" direction of FIG. 8, "down" is a "bottom" direction of FIG. 8. It should be understood that these orientation terms are only intended to facilitate describing the disclosure and simplifying descriptions, rather than indicating or implying that the referred apparatus or element must have a specific orientation, or must be configured and operated in a specific orientation, and thus cannot be understood as limitation to the disclosure.

Figure 1:
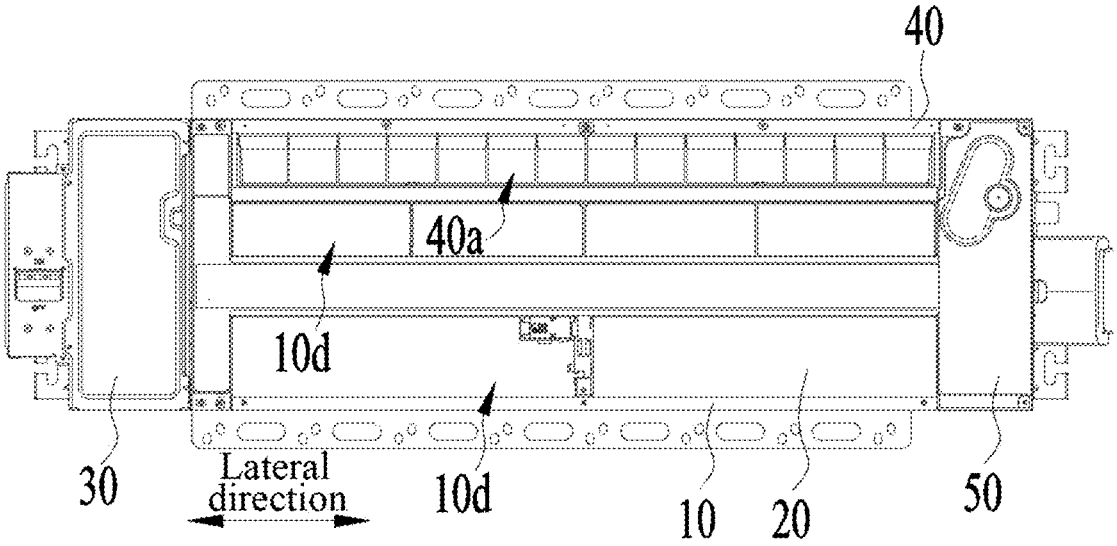
FIG. 1 is schematic structural diagram of an air-conditioning indoor unit according to an embodiment of the disclosure.

In descriptions of the disclosure, an orientation or position relationship of "lateral direction" is based on the orientation or position relationship shown in FIG. 1. It should be understood that these orientation terms are only intended to facilitate describing the disclosure and simplifying descriptions, rather than indicating or implying that the referred apparatus or element must have a specific orientation, or must be configured and operated in a specific orientation, and thus cannot be understood as limitation to the disclosure.

Figure 2:
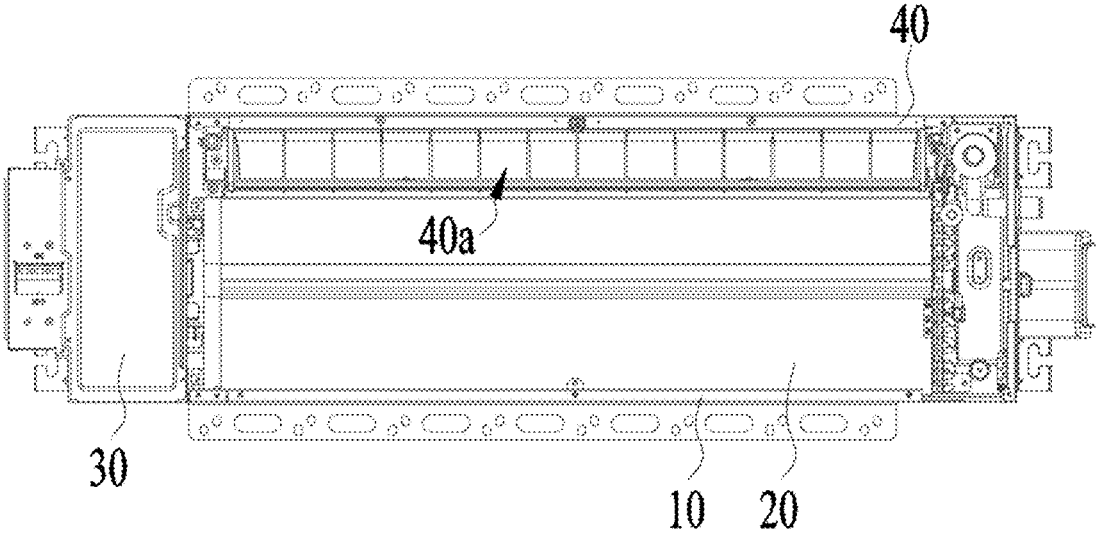
FIG. 2 is a schematic structural diagram of the air-conditioning indoor unit shown in FIG. 1 after a water collection tray is removed.
Figure 3:
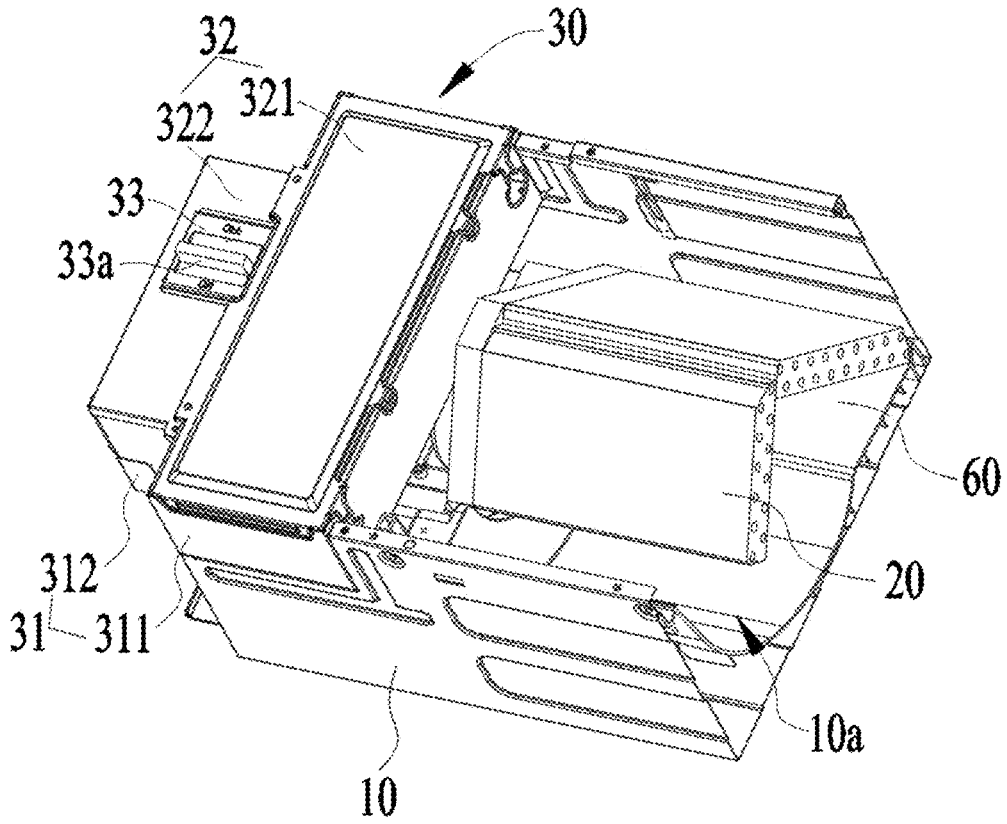
FIG. 3 is a schematic structural diagram of a part of the air-conditioning indoor unit shown in FIG. 1.

An embodiment of the disclosure provides an air-conditioning indoor unit, and with reference to FIG. 1 to FIG. 3, the air-conditioning indoor unit includes a housing 10, an evaporator 20, and an electric control box 30. An air duct 10*a* is formed in the housing 10; the evaporator 20 is arranged in the air duct 10*a*; and the electric control box 30 is arranged at a side of the evaporator 20, and at least a part of area of the electric control box 30 is located in the air duct 10*a*.

Another embodiment of the disclosure provides an air conditioner, the air conditioner includes the air-conditioning indoor unit described in any one of the embodiments of the disclosure.

The air-conditioning indoor unit described in the embodiments of the disclosure may be a ceiling unit, a ducted unit, etc.

The air duct 10*a* is a channel through which airflow circulates in the housing 10, that is, airflow from outside enters the air duct 10*a* from an air return port 10*d* of the air-conditioning indoor unit, exchanges heat at the evaporator 20, and then flows out from an air outlet 40*a* of the air-conditioning indoor unit.

There are multiple manners for forming the air duct 10*a*. For example, with reference to FIG. 3, an air duct shell 60 may be arranged in the housing 10, and the air duct shell 60 cooperates with the housing 10 to define the air duct 10*a*.

In some embodiments, the air duct 10*a* may also be directly formed of an inner space of the housing 10, instead of the air duct shell 60.

Figure 4:
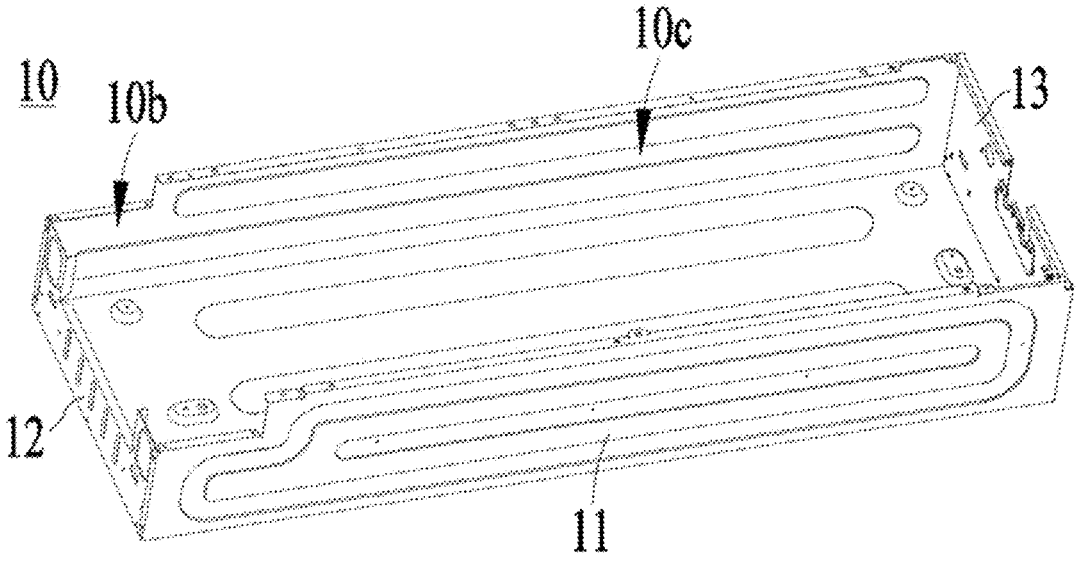
FIG. 4 is a schematic structural diagram of a housing shown in FIG. 1.
Figure 5:
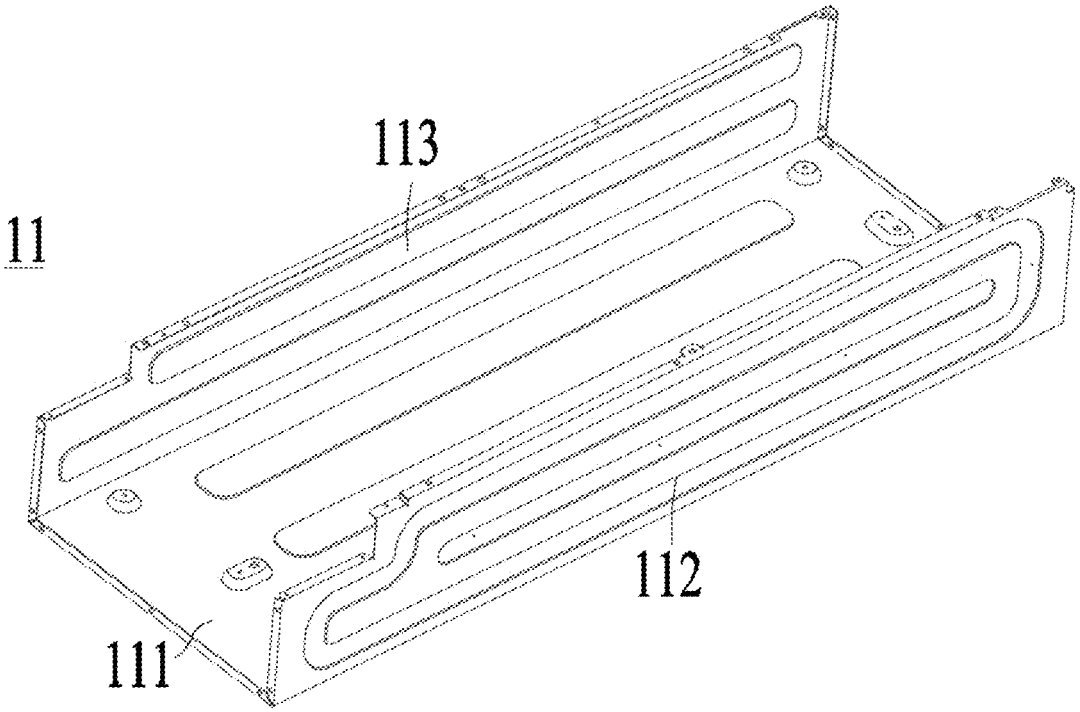
FIG. 5 is a schematic structural diagram of an underpan shown in FIG. 4.

There may also be various structural forms of the housing 10. Exemplarily, with reference to FIG. 4 and FIG. 5, the housing 10 may consist of an underpan 11, a first side plate 12 and a second side plate 13. The underpan 11 may use an integrally molded structure, that is, a bottom plate 111, a front side plate 112 and a rear side plate 113 of the underpan 11 may be integrally molded, and when the housing 10 is assembled, it only requires the first side plate 12 to be covered at the opened portion at a side of the underpan 11, and the second side plate 13 to be covered at the opened portion at another side of the underpan 11. Operations are simple and convenient, so that assembly efficiency of the housing may be improved.

In some embodiments, the underpan 11 may not use the integrally molded structure. For example, each of the bottom plate 111, the front side plate 112 and the rear side plate 113 may be an individual single plate, and they are assembled together during assembly.

The electric control box 30 is arranged at a side of the evaporator 20, and at least a part of area of the electric control box 30 is located in the air duct 10, therefore when the air-conditioning indoor unit is in an operation state, airflow flowing through the evaporator 20 may take away heat generated by the electric control box 30, so that a good heat dissipation function on the electric control box 30 may be achieved, and thus the heat dissipation effect of the electric control box 30 may be improved.

In an embodiment, with reference to FIG. 1 to FIG. 3, the electric control box 30 is located at a side of the evaporator 20 in a lateral direction.

When the air-conditioning indoor unit is in the operation state, negative pressure may be generated at both sides of the evaporator 20 in the lateral direction. Therefore, the electric control box 30 is arranged at a side of the evaporator 20 in the lateral direction, so that the heat generated by the electric control box 30 may be taken away better, and thus the heat dissipation effect of the electric control box 30 may be further improved.

There are multiple manners for arranging the electric control box 30. Exemplarily, with reference to FIG. 1 and FIG. 4, a part of area of the housing 10 is recessed toward an inner side of the housing 10 to form an installation space 10*b* communicated with the air duct 10*a*, and at least the part of area of the electric control box 30 is arranged in the installation space 10*b*.

Specifically, the electric control box 30 arranged in the installation space 10*b* may allow at least one of a sidewall, a bottom wall or a top wall of the electric control box 30 to close connection between the air duct 10*a* and the installation space 10*b* only (i.e., an arrangement shown in FIG. 3), which is equivalent to that an area of the electric control box 30 intended to close the connection between the air duct 10*a* and the installation space 10*b* forms a part of sidewall of the air duct 10*a*, and it may also be that a part of area of the electric control box 30 extends into the air duct 10*a* from the connection between the air duct 10*a* and the installation space 10*b*.

The installation space 10*b* formed on the housing 10 may not only facilitate installation of the electric control box 30, but also make an overall structure of the air-conditioning indoor unit more compact.

Furthermore, with reference to FIG. 1 to FIG. 4, an opening 10*c* communicated with the air duct 10*a* is provided at a side of the housing 10, and a part of sidewall of the housing 10 located at the opening 10*c* side is recessed to form the installation space 10*b*.

Specifically, the air return port 10*d* and/or the air outlet 40*a* of the air-conditioning indoor unit may be provided at the opening 10*c* of the housing 10.

With reference to FIG. 1 to FIG. 4, the benefit of forming the installation space 10*b* by recessing the part of sidewall of the housing 10 located at the opening 10*c* side is that when the electric control box 30 is installed in the installation space 10*b*, the sidewall at a side of the electric control box 30 and at least a part of the bottom wall may be located in the air duct 10*a*, which is equivalent to increasing an area of the electric control box 30 contacting with airflow in the air duct 10*a*, so that better heat dissipation of the electric control box 30 may be achieved.

In a specific embodiment, with reference to FIG. 1 and FIG. 2, the air-conditioning indoor unit includes an air outlet frame 40, a fan and a water collection tray 50, and the air outlet frame 40 is provided with an air outlet 40*a*; the air outlet frame 40 and the fan are arranged in the air duct 10*a*, the air outlet 40*a* is communicated with the air duct 10*a* and faces toward the opening 10*c*, the fan and the evaporator 20 are arranged at a same side of the air outlet frame 40, and the fan is located at a side of the evaporator 20 away from the opening 10*c*; and the water collection tray 50 is arranged at the opening 10*c* and faces toward the evaporator 20, and the water collection tray 50 avoids a part of area of the opening 10*c*, so that the area of the opening 10*c* avoided by the water collection tray 50 forms an air return port 10*d*.

That is, the air outlet 40*a* and the air return port 10*d* of the air duct 10*a* may be arranged at the same side of the housing 10, and the water collection tray 50 is intended to hold condensed water generated by the evaporator 20. Two air return ports 10*d* are separated by the water collection tray 50 shown in FIG. 1 at the opening 10*c*, to form. In some embodiments, the water collection tray 50 may also be separated at the opening 10*c*, to form one air return port 10*d* or more than two air return ports 10*d*.

When the fan operates, airflow from outside enters the air duct 10*a* from the air return port 10*d*, exchanges heat at the evaporator 20, and then flows out from the air outlet 40*a* of the air outlet frame 40. When the airflow flows through the evaporator 20, it takes away heat generated by the electric control box 30, and thus may achieve a heat dissipation function on the electric control box 30.

In some embodiments, the installation space 10*b* may not be formed in the housing 10. For example, the air duct 10*a* may be provided with a communication port communicated with outside, and the electric control box 30 is arranged on an outer surface of the housing 10. It may be that a sidewall at a side of the electric control box 30 closes the communication port, which is equivalent to that the sidewall of the electric control box 30 closing the communication port forms a part of sidewall of the air duct 10*a*. It may also be that the part of area of the electric control box 30 extends into the air duct 10*a* from the communication port.

In an embodiment, with reference to FIG. 3, the electric control box 30 includes a box body 31 and a box cover 32 openably and closably covered on the box body 31, the box body 31 is connected to the housing 10, and the box cover 32 is located out of the housing 10.

The box cover 32 is arranged out of the housing 10, which may facilitate a maintenance personnel to open the box cover 32 to check and fix components in the box body 31, to improve convenience of maintenance.

In an embodiment, with reference to FIG. 3, an air switch 33 may be arranged in the box body 31, and the air switch 30 is configured to control on or off of a power supply of the air-conditioning indoor unit. That is, during the maintenance personnel's maintenance, the maintenance personnel may toggle a control handle 33*a* of the air switch 33 first, to turn off the power supply of the air-conditioning indoor unit. After the maintenance is completed, the maintenance personnel may toggle the control handle 33*a* of the air switch 33 again, to turn on the power supply of the air-conditioning indoor unit. Therefore, convenience and safety of the maintenance may be further improved.

There are multiple structural forms of the electric control box 30. Exemplarily, with reference to FIG. 6 and FIG. 7, the box body 31 includes a main box 311 and a secondary box 312 connected to the main box 311, the box cover 32 includes a main box cover 321, and the electric control box 30 includes an electric control board 34; and a side of the main box 311 and a side of the secondary box 312 are opened, the electric control board 34 is arranged in the main box 311, the main box cover 321 is openably and closably covered at the opened portion of the main box 311, and the air switch 33 is arranged in the secondary box 312.

Figure 9:
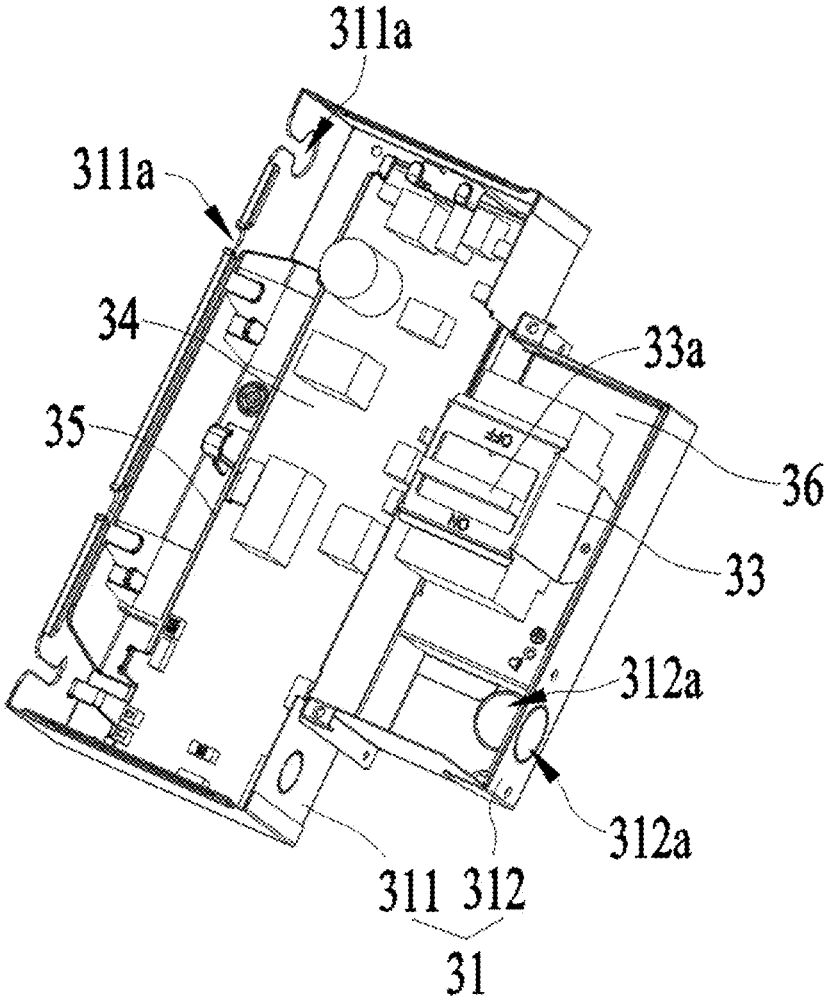
FIG. 9 is a schematic view of an internal structure of the electric control box shown in FIG. 7 from another view angle.

Specifically, the main box 311 is mainly intended for components such as the electric control board 34 to be arranged in it, and the secondary box 312 is mainly intended for the air switch 33 to be arranged in it, that is, the electric control board 34 and the air switch 33 may be arranged separately. With reference to FIG. 8 and FIG. 9, in order to facilitate installing and fixing the electric control board 34 and the air switch 33, an installation box 35 may be arranged in the main box 311, the electric control board 34 may be fixed in the installation box 35; a support frame 36 may be arranged in the secondary box 312, the air switch 33 is fixed on the support frame 36. During maintenance, the maintenance personnel toggles the control handle 33*a* of the air switch 33 in the secondary box 312 first, to turn off the power supply of the air-conditioning indoor unit, and then opens the main box cover 321, to check and fix components in the main box 311, such as the electric control board 34, etc.

Figure 7:
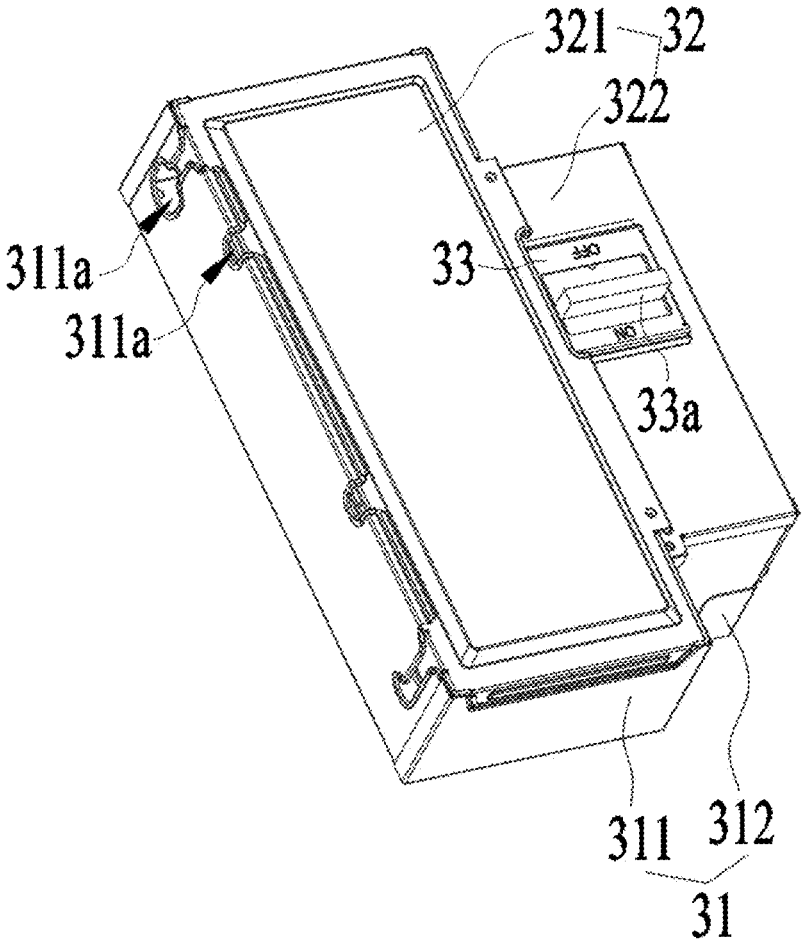
FIG. 7 is a schematic structural diagram of the electric control box shown in FIG. 1 from another view angle.

With reference to FIG. 7 to FIG. 9, in order to facilitate wiring, multiple first wire passage ports 311*a* may be arranged on the main box 311, and multiple second wire passage ports 312*a* may also be arranged on the secondary box 312. The number of first wire passage ports 311*a* and second wire passage ports 312*a* may be determined according to requirements. Exemplarily, with reference to FIG. 8 and FIG. 9, since the secondary box 312 is mainly intended for the air switch 33 to be arranged in it, the secondary box 312 may be provided with only two second wire passage ports 312*a*, one of the two second wire passage ports 312*a* may be arranged on a sidewall of the secondary box 312, and another one of the two second wire passage ports 312*a* may be arranged on a bottom wall of the secondary box 312, to facilitate a user to select an appropriate second wire passage port 312*a* to make wire go out according to actual requirements.

Furthermore, in order to facilitate toggling the control handle 33*a* of the air switch 33, the secondary box 312 may be arranged at a side of the main box 311 away from the evaporator 20. That is, compared with the electric control board 34, the air switch 33 may be arranged at a position close to an outer side of the electric control box 30, so that the maintenance personnel may touch the air switch 33 first.

In a specific embodiment, with reference to FIG. 3, the main box 311 is arranged in the installation space 10*b*, the secondary box 312 is arranged out of the installation space 10*b* and located at a side of the main box 311 away from the evaporator 20, and the main box 311 and the secondary box 312 are connected to the housing 10.

That is, when the housing 10 is formed with the installation space 10*b*, the main box 311 may be arranged in the installation space 10*b* to mainly dissipate heat of components in the main box 311, while the secondary box 312 is arranged out of the installation space 10*b* and located at a side of the main box 311 away from the evaporator 20, to facilitate the maintenance personnel to toggle the control handle 33*a* of the air switch 33.

Furthermore, the main box 311 and the secondary box 312 may also be fastened and connected to the housing 10 with fasteners such as screws, bolts, etc. Therefore, it may ensure that the main box 311 and the secondary box 312 may be securely fixed on the housing 10.

Figure 6:
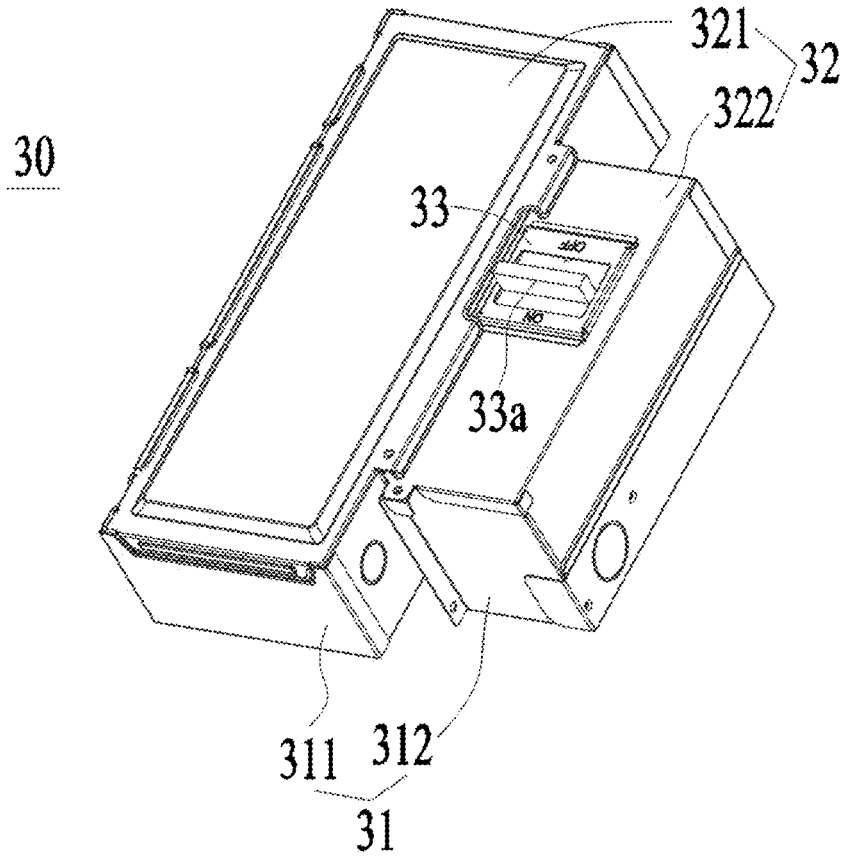
FIG. 6 is a schematic structural diagram of an electric control box shown in FIG. 1 from a view angle.

In an embodiment, with reference to FIG. 3, FIG. 6 and FIG. 7, the box cover 32 further includes a secondary box cover 322 provided with an avoidance port, the secondary box cover 322 is openably and closably covered at the opened portion of the secondary box 312, and a control handle 33*a* of the air switch 33 extends out of the secondary box cover 322 from the avoidance port.

The secondary box cover 322 may protect main structures of the air switch 33. Since it is usually unnecessary to check and fix the air switch 33, the secondary box cover 322 may remain in a normally closed state, and the maintenance personnel only needs to toggle the control handle 33*a* extending out of the secondary box cover 322 from the avoidance port, without opening the secondary box cover 322, operations are simple and convenient.

In some embodiments, the secondary box cover 322 may not be provided with the avoidance port, that is, the control handle 33*a* of the air switch 33 may also be located in the secondary box 312, and during maintenance, the maintenance personnel may open the secondary box cover 322 and then toggle the control handle 33*a*.

In some embodiments, the electric control box 30 may not be provided with the main box 311 and the secondary box 312, that is, all components such as the electric control board 34, the air switch 33 or the like in the electric control box 30 may be arranged in the same box body 31.

Various embodiments/implementations provided in the disclosure may be combined with each other, without conflict.

The above descriptions are only preferred embodiments of the disclosure, and are not intended to limit the disclosure. For those skilled in the art, various modifications and variations may be made to the disclosure. Any modification, equivalent replacement, improvement or the like made within the spirit and principle of the disclosure should be included in the scope of protection of the disclosure.

The invention claimed is:

1. An air-conditioning indoor unit comprising:

a housing, an air duct being formed in the housing;

an evaporator arranged in the air duct; and an electric control box arranged at a side of the evaporator, at least a part of the electric control box being located in the air duct, the electric control box including a box body, an electric control board, and an air switch configured to control on or off of a power supply of the air-conditioning indoor unit, the box body including a main box and a secondary box, the evaporator and the secondary box being located at two opposite sides, respectively, of the main box in a lateral direction, the electric control board being arranged in the main box, and the air switch being arranged in the secondary box;

wherein the electric control box includes a main box cover openably and closably covered at an opened portion of the main box, and a secondary box cover openably and closably covered at an opened portion of the secondary box, the secondary box cover is provided with an avoidance port, a control handle of the air switch extends out of the secondary box cover from the avoidance port, and a top surface of the main box cover is higher than a top surface of the secondary cover in a direction perpendicular to the lateral direction.

2. The air-conditioning indoor unit of claim 1, wherein a part of the housing is recessed toward an inner side of the housing to form an installation space communicated with the air duct, and at least a part of the electric control box is arranged in the installation space.

3. The air-conditioning indoor unit of claim 2, wherein an opening communicated with the air duct is provided at a side of the housing, and a part of sidewall of the housing located at the opening side is recessed to form the installation space.

4. The air-conditioning indoor unit of claim 3, further comprising:

an air outlet frame provide with an air outlet;

a fan; and a water collection tray;

wherein:

the air outlet frame and the fan are arranged in the air duct;

the air outlet is communicated with the air duct and faces toward the opening, the fan and the evaporator are arranged at a same side of the air outlet frame, and the fan is located at a side of the evaporator away from the opening; and the water collection tray is arranged at the opening and faces toward the evaporator, and the water collection tray avoids a part of the opening, so that the part of the opening avoided by the water collection tray forms an air return port.

5. The air-conditioning indoor unit of claim 1, wherein:

the air duct is provided with a communication port communicated with outside, and the electric control box is arranged on an outer surface of the housing; and a sidewall at a side of the electric control box closes the communication port, or the part of the electric control box extends into the air duct from the communication port.

6. The air-conditioning indoor unit of claim 1, wherein the secondary box is provided with two second wire passage ports, one of the two second wire passage ports is arranged on a sidewall of the secondary box, and another one of the two second wire passage ports is arranged on a bottom wall of the secondary box.

7. The air-conditioning indoor unit of claim 1, wherein a part of the housing is recessed toward an inner side of the housing to form an installation space communicated with the air duct, the main box is arranged in the installation space, and the secondary box is arranged out of the installation space.

8. An air conditioner comprising:

an air-conditioning indoor unit including:

a housing, an air duct being formed in the housing;

an evaporator arranged in the air duct; and an electric control box arranged at a side of the evaporator, at least a part of the electric control box being located in the air duct, the electric control box including a box body, an electric control board, and an air switch configured to control on or off of a power supply of the air-conditioning indoor unit, the box body including a main box and a secondary box, the evaporator and the secondary box being located at two opposite sides, respectively, of the main box in a lateral direction, the electric control board being arranged in the main box, and the air switch being arranged in the secondary box;

wherein the electric control box includes a main box cover openably and closably covered at an opened portion of the main box, and a secondary box cover openably and closably covered at an opened portion of the secondary box, the secondary box cover is provided with an avoidance port, a control handle of the air switch extends out of the secondary box cover from the avoidance port, and a top surface of the main box cover is higher than a top surface of the secondary cover in a direction perpendicular to the lateral direction.

9. The air conditioner of claim 8, wherein a part of the housing is recessed toward an inner side of the housing to form an installation space communicated with the air duct, and at least a part of the electric control box is arranged in the installation space.

10. The air conditioner of claim 9, wherein an opening communicated with the air duct is provided at a side of the housing, and a part of sidewall of the housing located at the opening side is recessed to form the installation space.

11. The air conditioner of claim 10, wherein the air-conditioning indoor unit further includes:

an air outlet frame provide with an air outlet;

a fan; and a water collection tray;

wherein:

the air outlet frame and the fan are arranged in the air duct;

the air outlet is communicated with the air duct and faces toward the opening, the fan and the evaporator are arranged at a same side of the air outlet frame, and the fan is located at a side of the evaporator away from the opening; and the water collection tray is arranged at the opening and faces toward the evaporator, and the water collection tray avoids a part of the opening, so that the part of the opening avoided by the water collection tray forms an air return port.

12. The air conditioner of claim 8, wherein:

the air duct is provided with a communication port communicated with outside, and the electric control box is arranged on an outer surface of the housing; and a sidewall at a side of the electric control box closes the communication port, or the part of the electric control box extends into the air duct from the communication port.

13. An air-conditioning indoor unit comprising:

a housing, an air duct being formed in the housing, the housing including an underpan, a first side plate, and a second side plate, the underpan including a bottom plate, a front side plate, and a rear side plate, each of a first end of the front side plate and a first end of the rear side plate being provided with a notch, and a size of the first side plate connecting the first end of the front side plate and the first end of the rear side plate being smaller than a size of the second side plate connecting a second end of the front side plate and a second end of the rear side plate;

an evaporator arranged in the air duct; and an electric control box arranged at a side of the evaporator, at least a part of the electric control box being located in the air duct, the electric control box being located on the notches of the front side plate and the rear side plate, and on the first side plate, the electric control box including a box body, an electric control board, and an air switch configured to control on or off of a power supply of the air-conditioning indoor unit, the box body including a main box and a secondary box, the evaporator and the secondary box being located at two opposite sides, respectively, of the main box in a lateral direction, the electric control board being arranged in the main box, and the air switch being arranged in the secondary box;

wherein the electric control box includes a main box cover openably and closably covered at an opened portion of the main box, and a secondary box cover openably and closably covered at an opened portion of the secondary box, the secondary box cover is provided with an avoidance port, a control handle of the air switch extends out of the secondary box cover from the avoidance port, and a top surface of the main box cover is higher than a top surface of the secondary cover in a direction perpendicular to the lateral direction.

* * * * *